United States Patent [19]

Forney et al.

[11] Patent Number: 4,998,895

[45] Date of Patent: Mar. 12, 1991

[54] PACKAGED ELECTRICAL CONNECTOR

[75] Inventors: Edgar W. Forney, Harrisburg; Andrew J. Gabany, Mechanicsburg; Tracy L. Smith, Harrisburg, all of Pa.

[73] Assignee: AMP Incorporated, Harrisburg, Pa.

[21] Appl. No.: 436,564

[22] Filed: Nov. 14, 1989

[51] Int. Cl.[5] ..... H01R 9/05

[52] U.S. Cl. ..... 439/585; 439/877; 439/932

[58] Field of Search ..... 439/585, 877, 878, 879, 439/880, 881, 882, 932; 206/328, 329, 331

[56] References Cited

U.S. PATENT DOCUMENTS 2,729,695 1/1956 Pierce ..... 439/877
3,238,494 3/1966 Bentley ..... 439/585
3,551,882 12/1970 O'Keefe ..... 439/585
3,810,076 5/1974 Hutter ..... 439/585

*Primary Examiner*—Joseph H. McGlynn
*Assistant Examiner*—Hen D. Vu
*Attorney, Agent, or Firm*—Gerald K. Kita

[57] ABSTRACT

A packaged connector 1 comprising, a preassembled connector 1 in a transparent package 25, a conductive contact 7 having a friction socket 18 facing an open end of the package 25, and a loose ferrule 24 precisely positioned by the package 25 concentrically with a barrel 21 of the connector 1 for one step crimp connection of the ferrule 24 on a shield 5 of a cable 2, a concentric space 31 defined between the ferrule 24 and the barrel 21 to receive the shield 5 of the cable 2.

14 Claims, 5 Drawing Sheets

PACKAGED ELECTRICAL CONNECTOR

FIELD OF THE INVENTION

The invention relates to a packaged electrical connector facilitating assembly of the connector to an electrical cable.

BACKGROUND OF THE INVENTION

Felty, Jr. et al. U.S. Pat. Nos. 3,590,481 and 3,443,683, disclose a known package that separates individual parts of an electrical connector from one another. Each part is applied to a cable by crimping. The cable must be moved from part to part, in turn. The package must be torn away to allow the cable to move from part to part. Difficulty is experienced if the parts are not moved into correct registration with each other, each time the cable is moved from part to part. Further difficulty is experienced if the package is severely torn away to dislodge parts before they can be assembled to the cable.

The present invention relates to an improved package that eliminates successive movement of the cable, and that holds the parts in position for a single crimp operation with the package in place over the connector. Eliminated are the need to move the cable from part to part, and the need to tear away the package to perform intermediate operations of the assembly procedure. The connector is preassembled to provide a one step assembly operation, with all of the parts of the connector preassembled and correctly positioned for assembly. The connector package allows the application of crimping forces through the package to apply the connector to a cable.

The invention will now be described by way of example by reference to the drawings.

DETAILED DESCRIPTION

Figure 1:
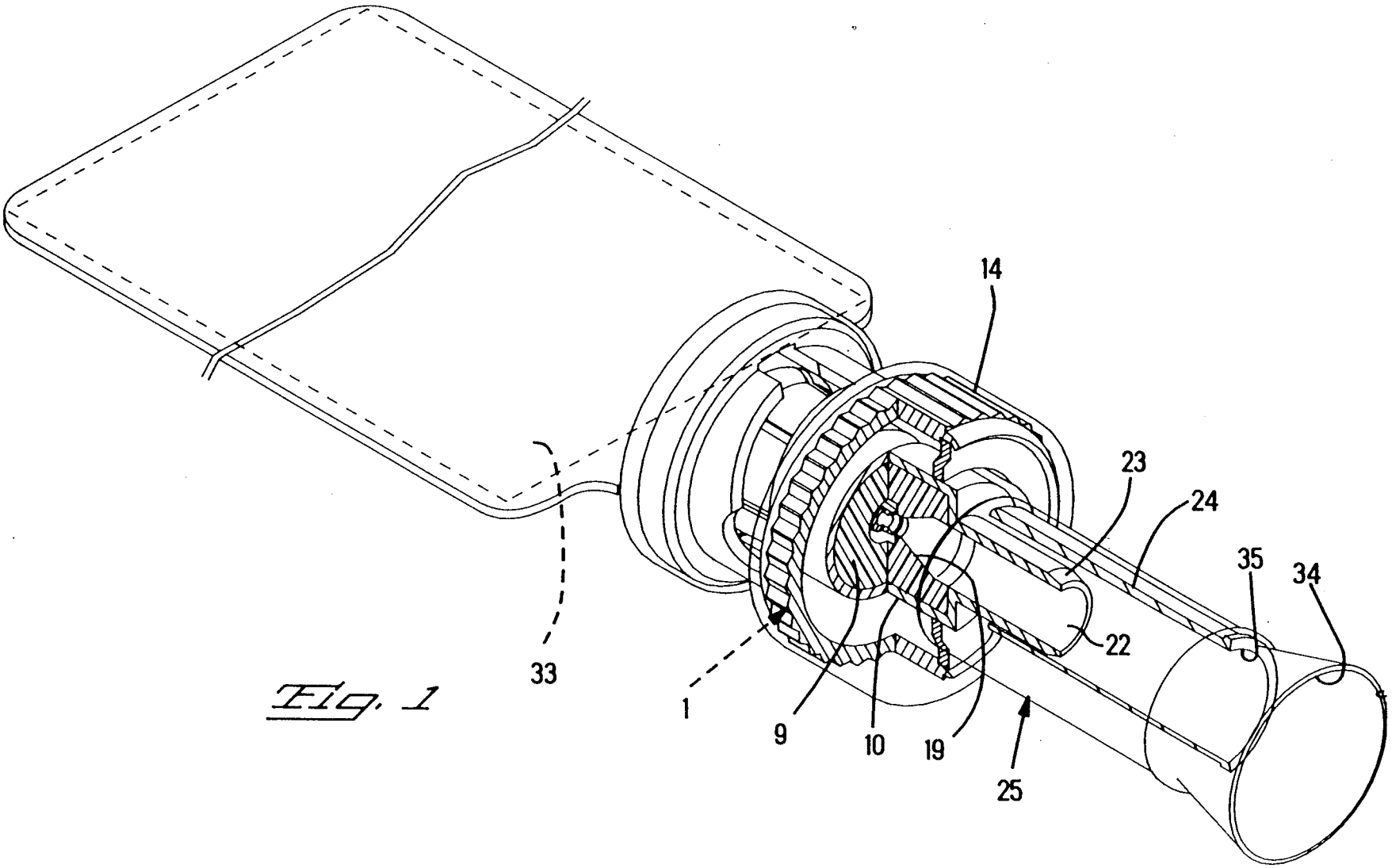
FIG. 1 of the drawings is a perspective view, partially cut away, of a packaged electrical connector.
Figure 2:
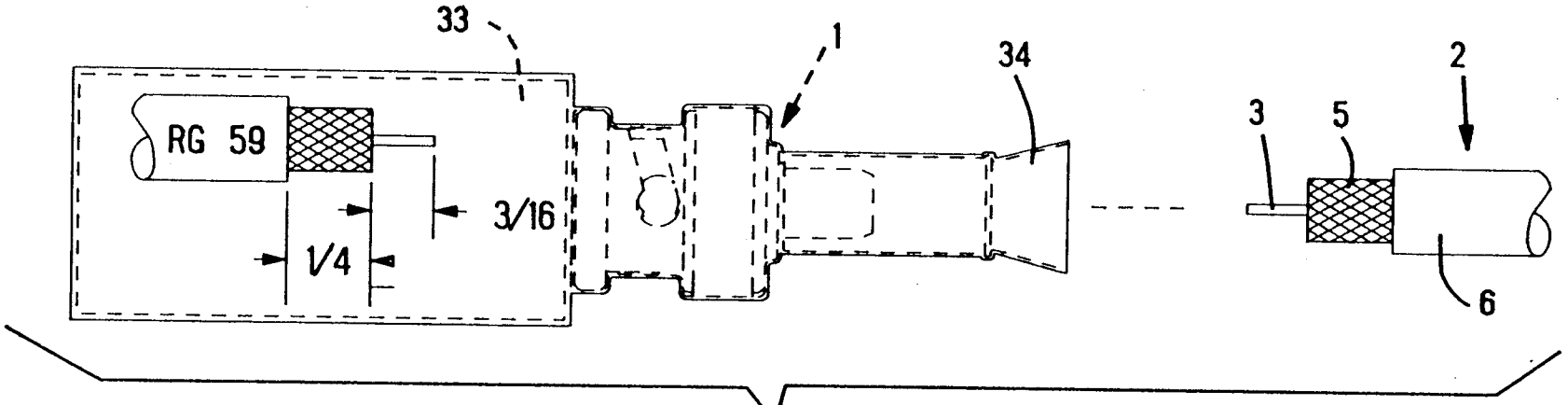
FIG. 2 is a fragmentary plan view of the packaged connector shown in FIG. 1 together with a cable.

With reference to FIGS. 1 and 2, a connector 1 is disclosed for connection to an electrical coaxial cable 2. The cable 2 includes a signal transmitting conductor 3, a concentric insulation 4 encircling the conductor 3, a concentric, cylindrical and conductive shield 5 encircling the insulation 4, and an outer jacket 6, FIGS. 5 and 6, of insulative material. The cable 2 is cut such that projecting lengths of the conductor 3, insulation 4 and shield 5 project from the remainder of the cable 2.

The connector 1 is based upon the design of a standard BNC connector disclosed by U.S. Pat. No. 4,165,911. The connector 1 includes a central electrical contact 7, FIGS. 5 and 6, having a front end 8 for disconnectable connection to a corresponding complementary connector, not shown. The contact 7 is assembled concentrically within an insulative, dielectric body 9. A hollow conductive shell 10 of the connector 1 concentrically encircles the dielectric body 9 and the contact 7. The dielectric body 9 insulates the contact 7 from the shell 10. A front portion 11 of the shell is press fit on the remainder of the shell 10 and is shaped for connection to the complementary connector, not shown. The front portion 11 has a rear, radially projecting flange 12 that faces a bellows type washer 13 over a depression in the remainder of the shell 10. A rotatable coupling nut 14 with bayonet coupling slots 15 is mounted for rotation on the shell 10, and for disconnectable connection to the complementary connector, not shown. The contact 7 includes a ring shaped, projecting collar 16 and a ring shaped barb 17 to lock against the dielectric body 9 and resist movement of the contact 7.

However, the contact 7 must be modified from the previous known construction to have a rear facing, friction socket 18 to receive therein the projecting center conductor 3 of the cable 2. The center conductor 3 is poked into the socket 18 and a friction electrical contact is established without a crimped connection or without a solder joint. The dielectric body 9 has a flared opening 19 in the rear end 20 to funnel the poked center conductor 3 into the socket 18.

Figure 5:
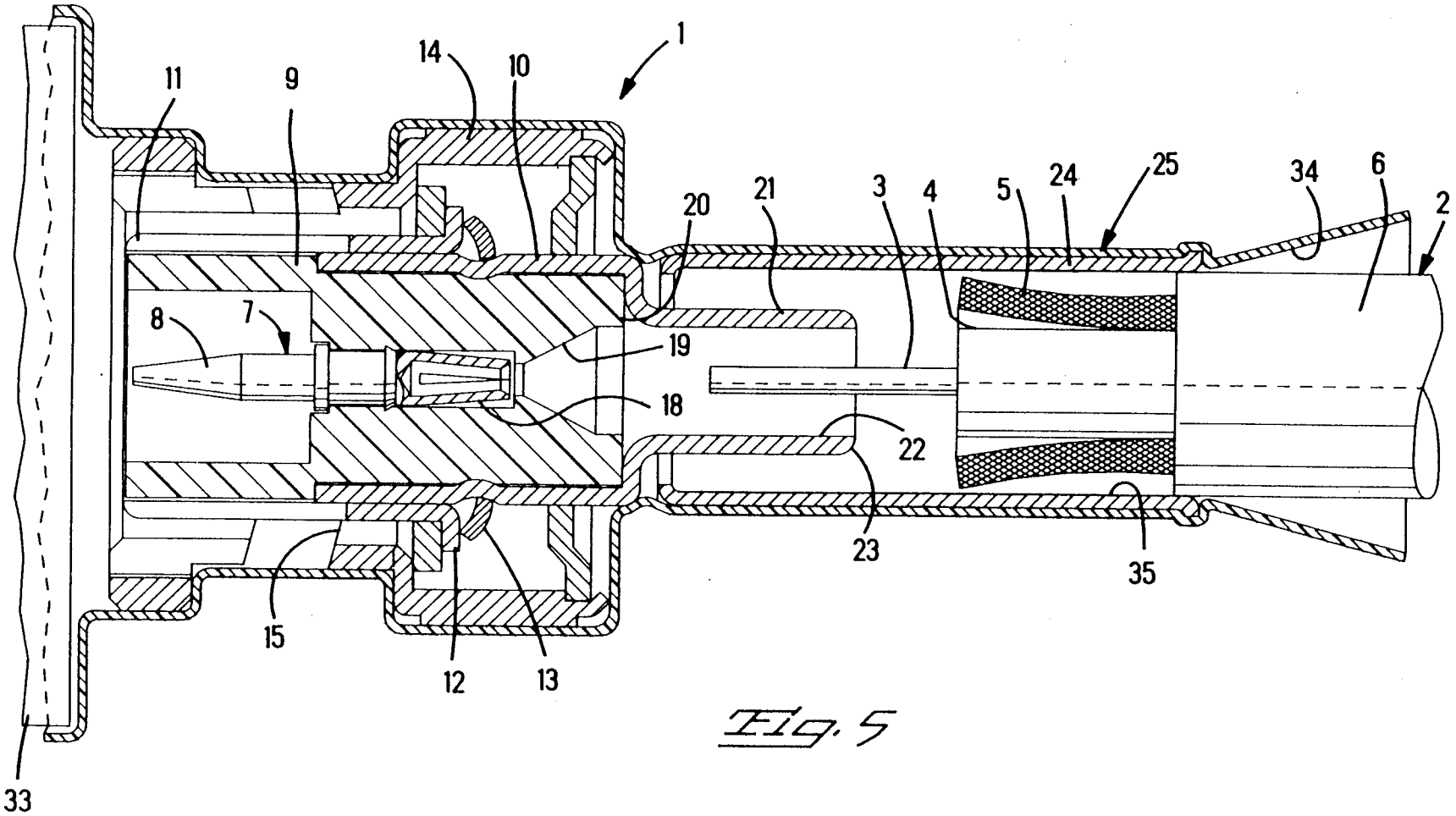
FIG. 5 is an enlarged fragmentary section view illustrating partial assembly of the packaged connector of FIG. 2 with the cable shown in FIG. 2.
Figure 6:
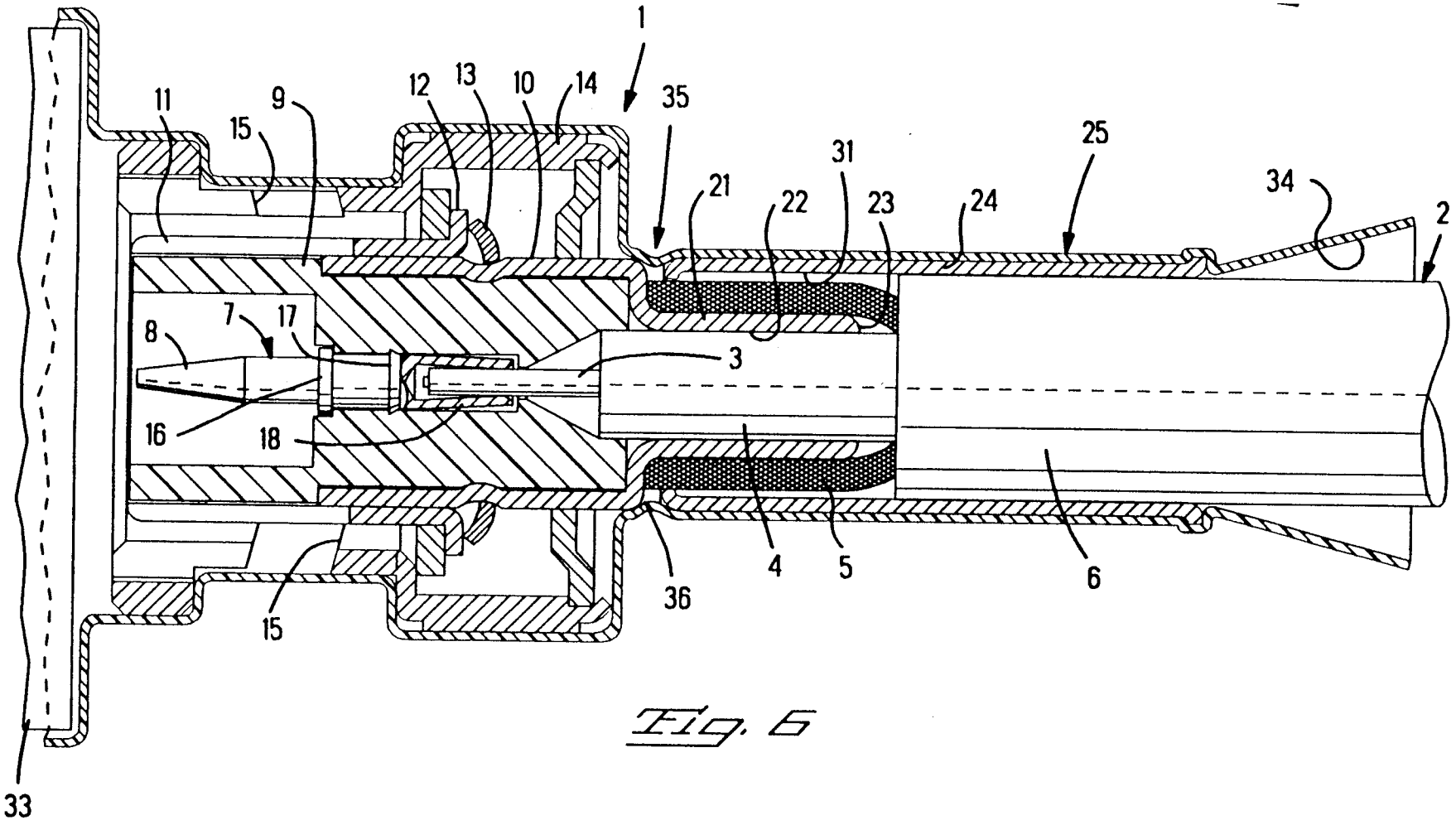
FIG. 6 is a view similar to FIG. 5 and illustrating complete assembly of the packaged connector with the cable.

The shell 10 includes a unitary crimp barrel 21 of reduced diameter with a rearward facing, open end 22 with an external encircling chamfer 23, FIGS. 1, 5 and 6.

A hollow cylindrical crimp ferrule 24 is a loose part and is positioned concentrically over the shield 5 and is radially deformed to clamp the shield 5 concentrically between it and the barrel 21. Radial deformation of the ferrule 24 toward the barrel 21 is accomplished by a known tool, to provide a crimped electrical connection of the shield 5 and the shell 10. Because the ferrule 24 is a loose part, it is must be moved into position over the shield 5, after the shield 5 has been located over the barrel 21. If the ferrule 24 is imprecisely located, the crimp connection would fail quality inspection.

A feature of the invention is, that a package 25 holds the loose part ferrule 24 in a precise location with respect to the barrel 21, such that assembly of the cable 2 and a crimp connection are established without having to move the parts into precise location or causing an error in locating the parts in position. The package 25 is constructed from a transparent film shaped into a tube 26, FIG. 3, of transparent Surlyn, vinyl or other suitable heat recoverable material. The tube 26 has been heated and stretched radially, to expand the tube 26 radially while the material has become softened by the heat. The stretched and expanded tube 26 is then cooled while held in its expanded condition, to stiffen the material, and thereby to retain its stretched shape. Upon the application of heat to the radially stretched and expanded tube 26, the material will soften and allow the internal stretching stresses present in the material to contract the stretched tube 26. The stretched tube 26 when heated will soften and radially contract and tend to return to its unstretched tubular shape.

Figure 4:
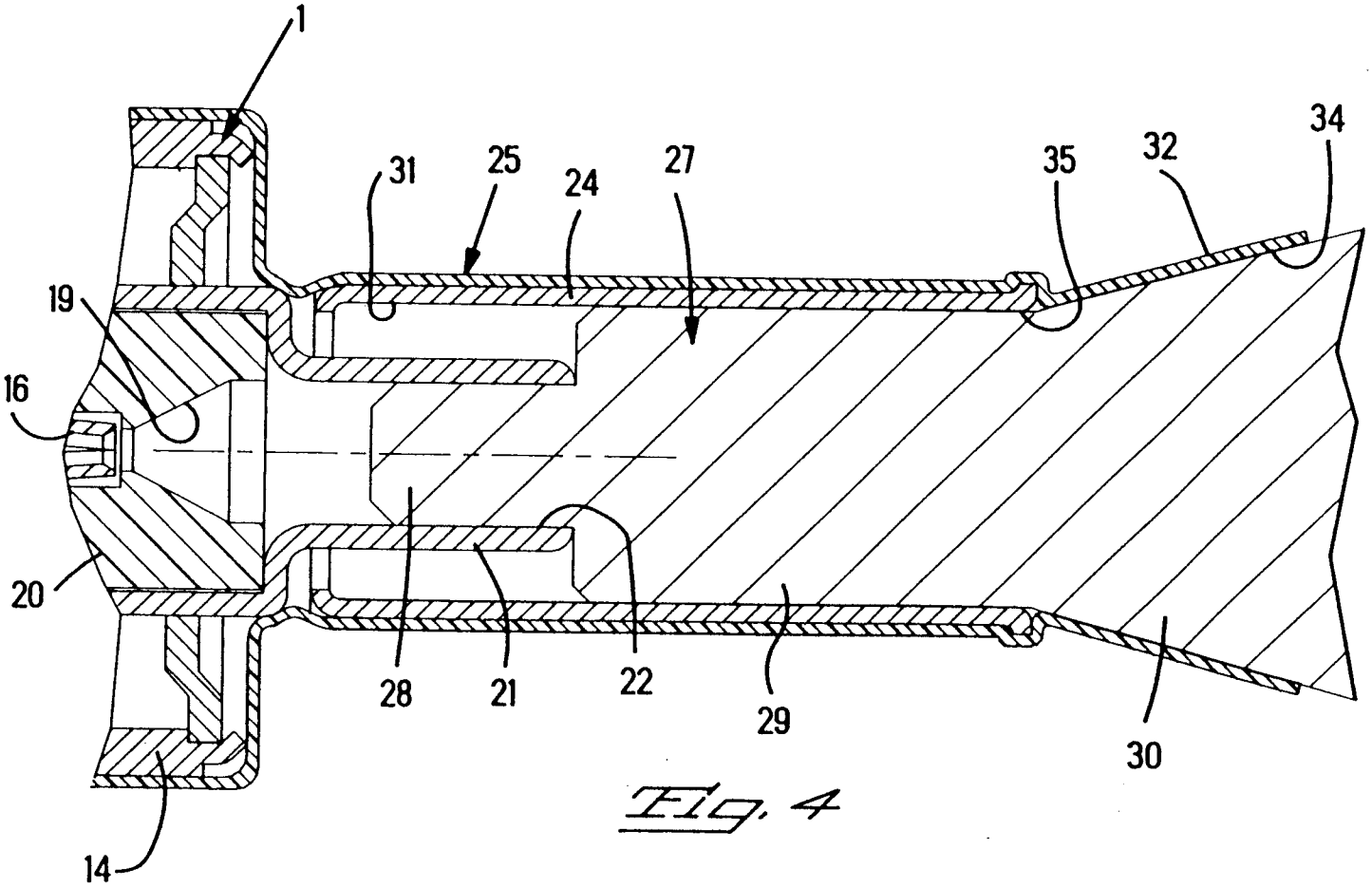
FIG. 4 is a fragmentary section view of the packaged connector and a mandrel.

A stepped cylindrical mandrel 27, FIG. 4, has a tip 28 of external diameter to fit concentrically in the barrel 21, an intermediate section 29, behind the tip 28, of larger diameter to fit inside the ferrule 24, and an outwardly flared section 30 extending from the intermediate section 29. The intermediate section 29 is axially aligned with the tip 28 and fits closely with the ferrule 24, such that the ferrule 24 is precisely located by the mandrel 27. The ferrule 24 is located by the mandrel 27 to concentrically encircle the barrel 21. The mandrel 27 shape creates a concentric space 31 between the ferrule 24 and the barrel 21 when the barrel 21 is located by the mandrel 27. The ferrule 24 is located by the mandrel 27 to overlap the barrel 21 at a precise axial position along the shell 10, such that the crimp connection can be formed without having to move the ferrule 24 from its position concentric and spaced relative to the barrel 21.

Figure 3:
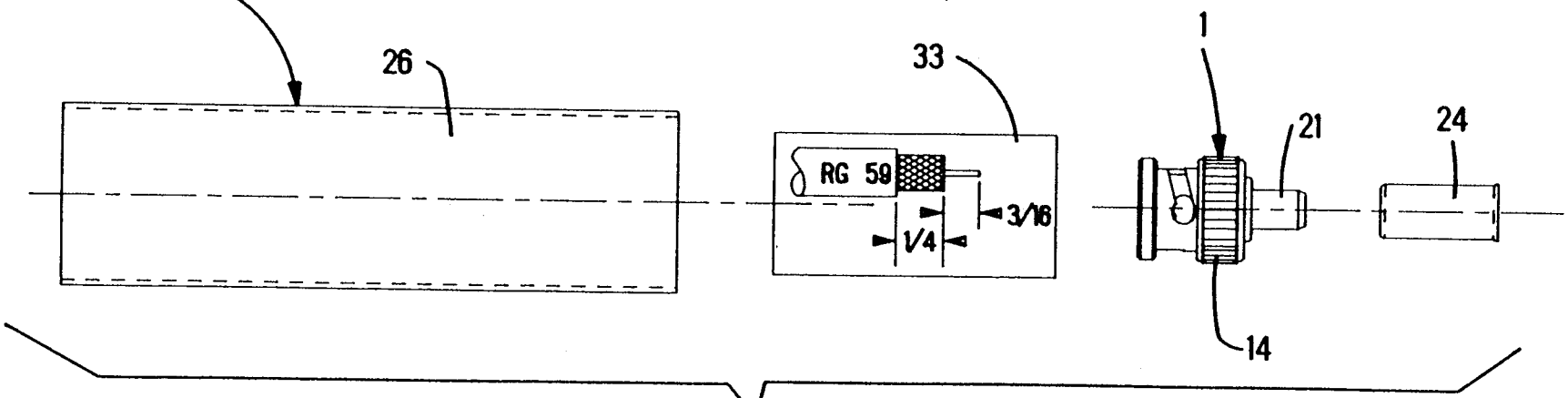
FIG. 3 is a view similar to FIG. 2, with parts shown exploded apart.

With reference to FIGS. 2, 3 and 4, the connector 1 and the mandrel 27 are assembled along an interior of the stretched tube 26. An end 32 of the tube 26 encircles the flared section 30. A tag 33 is inserted into an opposite end of the tube 26 and projects outwardly of a front end of the connector 1. The tube 26 is heated to soften the tube 26 and to contract the tube 26. Contraction of the tube 26 ceases when the tube 26 internally contacts and conforms to the exterior surfaces of the tag 33, the connector 1 and the flared section of the mandrel 27. The tube 26 is cooled to allow the tube 26 to stiffen and retain its conforming shape. The mandrel 27 is removed from the stiffened and contracted tube 26. The contracted tube 26 provides a transparent package 25 for the connector 1. The flared section 30 of the mandrel 27 forms a flared open end 34 of the package 25 that projects from an open end 35 of the ferrule 24.

The connector 1 is preassembled, meaning, that the nut 14, shell 10, dielectric body 9 and contact 7 are assembled to one another, and the ferrule 24 is positioned by the package 25, in readiness for assembly of the cable 2 with the connector 1.

When the cable 2 is poked into the flared, open end of the package 25, the insulation 4 will enter the open end 22 of the barrel 21 that faces the flared open end 34 of the package 25, the shield 5 will be deflected radially outward, by the chamfer 23 on the end 22 of the barrel 21, and into the concentric space 31 maintained by the package 25 between the barrel 21 and the ferrule 24. The insulation 4 of the cable 2 is closely surrounded by the barrel 21 to insure that the shield 5 of the cable 2 does not enter the barrel 21 together with the insulation 4. The barrel 21 is hollow with an internal diameter that closely confines the projecting insulation 4 of the cable 2, when the insulation 4 is poked into the barrel 21. The confining barrel 21 closely encircles the insulation 4 to prevent the projecting shield 5 from entering the barrel 21 with the insulation 4. The chamfer 23 on the end 22 of the barrel 21 will enter the open end of the shield 5 and will radially expand the shield 5, such that the shield 5 will concentrically overlap the exterior of the barrel 21 as the insulation 4 is poked into the barrel 21. The insulation 4 is poked into the barrel 21 with one motion that also pokes the conductor 3 into an open end of the socket 18 that faces the open end 34 of the package 25. The insulation 4 enters the opening 19 and stops against the flared interior of the opening 19.

The mandrel 27 assures concentricity of the package 25 that has been contracted against the ferrule 24. When the mandrel 27 is removed, the stiffened tube 26 is sufficiently rigid to hold the ferrule 24 in a precise location and to maintain the ferrule 24 overlapping and spaced radially from the barrel 21. When the mandrel 27 is removed, it is the package 25 which positions the ferrule 24 and the barrel 21 overlapped and concentrically spaced for one step assembly with the cable 2 and a one step crimping operation while the package 25 remains in place.

The tag 33 is a stiff paper and is further stiffened by the package 25. The tag 33 provides a stiff handle to assist in holding the packaged connector 1 during assembly of the cable 2. The tag 33 extends forwardly of the connector 1 and is handy to grasp while the cable 2 is grasped and inserted into the end 34 of the package and into the connector 1 from the rear. The tag 33 carries indicia comprising dimensions of the projecting lengths of the conductor 3, the insulation 4 and the shield 5 that project from the remainder of the cable 2. Each of the features, advantages and objectives of the invention contributes to the invention, and is independent of the others.

An inspection window 35, FIG. 6, is in the transparent package 25. A clearance 36 is between the crimp ferrule 24 and the shell 10 and beneath the window 35. The package 25 holds the parts 24 and 10 apart to provide the clearance 36. The shield 5 is observed through the window 35 to verify that the shield 5 is correctly in position before crimping through the package to connect the ferrule 24 and the shield 5 and the barrel 21.

We claim:

1. A packaged connector comprising, a preassembled connector 1 in a transparent package, wherein the improvement comprises;

the connector includes an electrical contact having a friction socket facing an open end of the package, and a loose crimp ferrule is precisely positioned by the package concentrically with a barrel of the connector for one step crimping of the ferrule radially toward the barrel, a concentric space is defined between the ferrule and the barrel, and open ends of the ferrule and the barrel face the open end of the package.

2. A packaged connector as recited in claim 1, wherein the improvement comprises; a clearance in between the ferrule and the shell and beneath an inspection window.

3. A packaged connector comprising: a preassembled connector contained in a transparent package, the connector including a conductive contact having a friction socket facing an open end of the package for receiving and making frictional contact with a conductor of a coaxial cable inserted into the open end and into the socket, and a loose crimp ferrule is contained in and is held by the package concentrically encircling a barrel of the connector for one step crimping of the ferrule radially toward the barrel, the package retaining the barrel and the ferrule with a concentric open space therebetween for receiving a conductive shield of the cable in the open space, and open ends of the ferrule and the barrel face the open end of the package for receiving the shield of the cable in the open end of the package and concentrically between the corresponding open ends of the ferrule and the barrel.

4. A packaged connector as recited in claim 3, comprising: the socket is encircled by a dielectric body having a flared opening facing the open end of the package.

5. A packaged connector as recited in claim 3, comprising: a tag in the package and being held by the package, the connector being held by the package between the tag and the open end of the package.

6. A packaged connector as recited in claim 3, comprising: the package is a shrunken tube conforming to the shape of the ferrule.

7. A packaged connector as recited in claim 3, comprising: the open end is flared.

8. A packaged connector as recited in claim 3, comprising: the socket being in the connector forwardly of the barrel and a dielectric body encircling the socket, and a flared opening of the dielectric body facing the open end of the package.

9. A packaged connector as recited in claim 3, comprising: a handle separate from the connector to be grasped to hold the package and the connector while corresponding portions of the cable are assembled into the respective open ends of the package and the ferrule and the barrel, and while the conductor of the cable is inserted into the socket.

10. A method of fabricating a packaged connector, comprising the steps of: assembling a connector and a loose piece crimp ferrule over a mandrel, assembling a transparent film over the connector and the ferrule and the mandrel, and shrinking the film to a shape that positions the ferrule concentric with a portion of the connector and a concentric space between the ferrule and the portion of the connector to receive a conductive shield of a cable for one step crimping between the ferrule and the portion of the connector.

11. A method as recited in claim 10, comprising the steps of: providing in the package a tag projecting forwardly of a front end of the connector.

12. A method as recited in claim 10, comprising the steps of: providing a handle separate from the connector, and holding the handle while assembling the cable and the connector.

13. A method as recited in claim 10, comprising the steps of: contracting the film in engagement with the connector, the ferrule and the mandrel.

14. A method as recited in claim 10, comprising the steps of: forming a flare on the film projecting from an open end of the ferrule.

* * * * *

UNITED STATES PATENT OFFICE

CERTIFICATE OF CORRECTION

Patent No. 4,998,895 Dated March 12, 1991

Inventor(s) Edgar W. Forney et al.

It is certified that error appears in the above-identified patent and that said Letters Patent is hereby corrected as shown below:

Claim 1, Column 4, Line 26 - delete the number "1".

Signed and Sealed this

Twelfth Day of January, 1993

*Attest:*

DOUGLAS B. COMER

*Attesting Officer*

*Acting Commissioner of Patents and Trademarks*